US012331257B1

(12) United States Patent
Dubinevych

(10) Patent No.: US 12,331,257 B1
(45) Date of Patent: Jun. 17, 2025

(54) SOLID COMPOSITION FOR IMPROVING COMBUSTION ENGINE EFFICIENCY

(71) Applicant: Serhii Dubinevych, Miami, FL (US)

(72) Inventor: Serhii Dubinevych, Miami, FL (US)

( * ) Notice: Subject to any disclaimer, the term of this patent is extended or adjusted under 35 U.S.C. 154(b) by 0 days.

(21) Appl. No.: 18/637,059

(22) Filed: Apr. 16, 2024

(51) Int. Cl.
*C10L 10/02* (2006.01)
*C10L 9/02* (2006.01)

(52) U.S. Cl.
CPC ..... *C10L 10/02* (2013.01); *C10L 9/02* (2013.01); *C10L 2200/0209* (2013.01); *C10L 2200/0213* (2013.01); *C10L 2200/0227* (2013.01); *C10L 2200/0231* (2013.01); *C10L 2200/029* (2013.01)

(58) Field of Classification Search
CPC .... C10L 10/02; C10L 9/02; C10L 2200/0209; C10L 2200/0213; C10L 2200/0227; C10L 2200/0231; C10L 2200/029
See application file for complete search history.

(56) References Cited

U.S. PATENT DOCUMENTS 1,675,309 A * 6/1928 Jaeger ..... C01B 17/79
423/538
1,694,620 A * 12/1928 Jaeger ..... C01B 33/46
423/598

* cited by examiner

*Primary Examiner* — Cephia D Toomer
(74) *Attorney, Agent, or Firm* — Fitch Even Tabin & Flannery LLP

(57) ABSTRACT

A solid composition comprising copper (Cu), zinc (Zn), molybdenum (Mo), tungsten (W), vanadium (V), tin (Sn) and silver (Ag), which improves performance of combustion engines by decreasing fuel consumption and levels of emission, particularly soot (particulate matter, or PM), carbon monoxide (CO), carbon dioxide ($CO_2$) and nitrogen oxides (NOx), in an economically efficient way.

13 Claims, No Drawings

SOLID COMPOSITION FOR IMPROVING COMBUSTION ENGINE EFFICIENCY

TECHNICAL FIELD

This invention relates generally to improving efficiency and decreasing emission levels of combustion engines that use hydrocarbon fuels and, more specifically, to solid compositions for improving the efficiency of combustion engines.

BACKGROUND

Due to the climate changes that are likely to result from the industrial development of human civilization and the subsequent rise of carbon dioxide content in the Earth's atmosphere, it is important to drastically reduce our consumption of carbon-based fuel to avoid the climate changes becoming irreversible. A significant part of carbon dioxide emissions has transport vehicles as their source. Unfortunately, it is not possible to switch commercial transportation to zero-emission quickly, but its negative impact may be reduced.

The use of various metals in attempts to increase the combustion efficiency of hydrocarbon fuels and to decrease emission levels, by treatment of fuel before combustion, was ongoing for quite some time, although none of the approaches gained wide popularity or commercial success. Among possible drawbacks may have been complexity and wide variability of contents, presence of expensive components (e.g., noble metals), difficulties of preparation (admixing to the fuel at a particular rate, etc.).

For example, WO/1982/001375 (29 Apr. 1982) discloses a composition to improve the combustion of fuels for energy generation, reduced corrosion, and deposition on heat-transferring and other surfaces heavy oils for energy generation. The aqueous solution can be supplied to the combustion zone in a quantity of up to about 5% by volume based on the volume of the fuel. A particularly preferred quantity of additive in the form of an aqueous solution is about 0.5-2% by volume. This composition includes at least the elements aluminum, manganese, and zinc, and dependent on the contents of trace elements of the fuel the composition, may also contain magnesium. The effect is shown by a decrease in exhaust gas temperature and in an excess of air.

Application GB2317921A (8 Apr. 1998) discloses an apparatus that comprises a catalyst alloy or amalgam made from a formulation of four or more of the metals: antimony, barium, cadmium, calcium copper, gold, lead, mercury, nickel, palladium, platinum, ruthenium, silver, tin, and zinc. This fuel catalyst may be used as a coating or lining to the fuel tank and (or) its internal components and (or) the fuel line which transports the fuel to the point of combustion.

WO 1999/66009 (23 Dec. 1999) discloses an enhanced combustion structure, and the addition of a metallic (non-lead element, selected from the group consisting of 1A, 2A, 3B, 4B, 5B, 6B, 7B, 8, 1B, 2B, 3A, 4A, 5A, 6A, or 7A elements of the Periodic Chart) together with an ECS (organic) compound. At least a 2% improvement in thermal efficiency is claimed.

WO2022043849 (3 Mar. 2022) discloses diesel fuel and a fuel oil soot-reducing additive, consisting of a mixture of iron and cerium salts, organic nitrate, and a dispersing agent.

US 2023/0257670 (17 Aug. 2023) discloses an additive composition for a marine fuel or a heating oil comprising a colloidal dispersion of catalytic particles of cerium, nickel, palladium, and platinum, an organic compound, and a carrier fluid. Efficiency is shown for reducing soot and carbon monoxide in the exhaust.

WO 2023/064959 (20 Apr. 2023) mentions a combustion catalyst including a soluble organometallic compound, the metal being magnesium, potassium, calcium, manganese, iron, cerium, and/or platinum, or a metal oxide, suspended in a solvent, where metal is chosen from the same group, except platinum.

U.S. Pat. No. 7,503,944 (17 Mar. 2009) also proposes the addition of a catalyst or combustion enhancer to the fuel, although extremely diluted: from 1 part per 200 million parts to 1 part per 6 trillion parts, although there are no efficiency data presented, proving the efficiency of such sparingly used additives.

Another similar approach, described in CN109012714A (18 Dec. 2018), also proposes an improvement of fuel oil by the addition of a catalyst which comprises the following ingredients: Hg, Se, Sn, Ni, Zn, Mn, Tl, As, Cr, Ga, Ba, S, B, Mg, K, Al, Ca, Na, Si and Fe.

SUMMARY

It was found by the inventors that a solid composition, which comprises copper (Cu), zinc (Zn), molybdenum (Mo), tungsten (W), vanadium (V), tin (Sn) and silver (Ag), significantly improves the performance of combustion engines, particularly, by lowering their fuel consumption and emission levels, especially the levels of soot (particulate matter, or PM), carbon monoxide (CO), carbon dioxide ($CO_2$) and nitrogen oxides (NOx).

As such, in some embodiments, a solid composition that improves the fuel consumption efficiency and emission levels of combustion engines comprises Cu, Zn, Mo, W, V, Sn, and Ag. In some aspects, the composition may include oxides, hydroxides, and/or salts.

Cu may be present in the form of copper sulfate, Zn may be present in the form of zinc acetate; Mo may be present in the form of molybdates, W may be present in the form of wolframates, and V may be present in the form of vanadates. In some aspects, molybdates, wolframates and vanadates are salts of monovalent cations (such as sodium, potassium, and ammonium). Sn may be present in the form of salt, oxide, or hydroxide, and Ag in metallic form.

For instance, the solid composition according to some embodiments of the present invention may comprise Cu in the form of $CuSO_4$*5H2O, $CuSO_4$, or it may comprise a combination of both said salts. Zn may be in the form of $Zn(CH_3COO)_2$*$2H_2O$. Mo may be in the form of $Na_2MoO_4$, $Na_2MoO_4$*$2H_2O$, and/or $(NH_4)_6Mo_7O_{24}$*$4H_2O$. Alternatively, Mo may be present as a combination of some or all of said salts. W may be present in the form of $Na_2WO_4$, $Na_2WO_4$*$2H_2O$, $3Na_2WO_4$*$9WO_3$*$xH_2O$, or in a combination with some or all of the salts. V may be in the form of $KVO_3$, $NaVO_3$, and/or $NH_4VO_3$, or in a combination with some or all of the salts. In some embodiments, Sn may be in the form of SnO.

In some embodiments, the solid composition according to the present invention may comprise components in the following ratio of their respective sources: between about 35 and about 70 wt. % of Cu, between about 20 and about 40 wt. % of Zn, between about 1 and about 10 wt. % of Mo, between about 1 and about 10 wt. % of W, between about 1 and about 10 wt. % of V, between about 1 and about 10 wt. % of Sn, and between about 1 and about 5 wt. % of Ag.

In some aspects, the solid composition may further contain one or more additional components, including but not limited to excipients, fillers, bulking agents, binders, and solid diluents. The additional components may be chosen from a group that contains, for example, polymeric particles, chalk, limestone, sand, sandy gravel, silica, borosilicate, ceramic, fly ash, clay. The group may also contain resins; acrylic, styrene, or vinyl polymer latex; alkyd, polyurethane, polyester, phenol formaldehyde or epoxy resin, and combinations thereof. One, several, or all of the additional components may be soluble in fuel, for instance, gasoline, diesel fuel, etc.

In some aspects of the invention, a three-dimensional product may comprise the solid composition mentioned above.

In another aspect of this invention there is presented a method of obtaining a three-dimensional product, wherein the above-mentioned solid composition is formed, coated on the surface of an inert substrate, or, enclosed in a fuel-soluble matrix, in various shapes (for example, in the shape of granules, rods, tubes, rings, cubes, pyramids, tablets, blocks, or bricks, etc.).

In a yet another aspect, a method of increasing efficiency of combustion engines includes, prior to ignition, bringing the fuel into contact with the above-mentioned solid composition, or with the above-mentioned three-dimensional product that comprises the above-mentioned solid composition.

One further aspect of the invention is a use of the solid composition, or of the product, for increasing the efficiency of combustion engines.

Increasing the efficiency of combustion engines, mentioned in connection with the method and use, may comprise decreasing fuel consumption and emission levels, wherein emission comprises soot (particulate matter, or PM), carbon monoxide (CO), carbon dioxide ($CO_2$) and nitrogen oxides (NOx).

DETAILED DESCRIPTION

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

It is well known that catalysts can increase the speed of chemical reactions or enable reactions at less stringent conditions. In the context of combustion engines, catalysts may be useful when it is evident that the fuel burning reaction is not complete. Incomplete burning of fuel in combustion engines is often accompanied by a formation of soot (or particulate matter (PM)). When fuel is not fully burned, the operation of the engine is suboptimal, i.e., the same amount of fuel does less work than in optimal conditions, i.e., the fuel efficiency of the engine decreases. The causes of less fuel-efficient engine operation may be many: poor quality of fuel, extreme modes of engine operation (increased rotations per minute or r.p.m.), rapid braking, low excess of air oxygen, dust, soot deposited on the valves or turbine blades; worn out elements of the engine, etc. The main effect of those causes will most likely be an increased fuel consumption, higher than what the manufacturer originally declared for the corresponding vehicle. Incomplete combustion of fuel leads to an increase in fuel consumption, because part of the fuel cannot burn in time, resulting in a formation of soot, and therefore, a larger volume of fuel is required to reach the desired engine efficiency.

Without being bound to a particular theory, as will be discussed in more detail below, compositions according to embodiments of the present invention result in an increased rate of fuel combustion.

It was found that the present invention is most useful in situations when combustion engines work in suboptimal conditions and consume more fuel. It often happens when an engine is, for example, worn out (or, in other words, its resources are partially spent). The compositions according to the present invention will often demonstrate the best effect when employed in connection with an engine that is worn out at least to some degree. Notably, a new or recently serviced engine will also benefit (but less) from the present invention since a new and properly tuned engine provides conditions for optimal combustion and leaves less room for efficiency improvement. Worsening of fuel efficiency in a worn-out engine may be explained, for example, by lower oxygen availability, and/or increased heterogeneity of the fuel-air mixture, containing not only fumes, but also small droplets and particles of soot. The role that a combustion catalyst plays is increasing the rate of fuel combustion, thus contributing to the full burning of the fuel.

The components of the composition according to embodiments of this invention include, as was mentioned above, copper (Cu), zinc (Zn), molybdenum (Mo), tungsten (W), vanadium (V), tin (Sn) and silver (Ag).

Cu may be present as metallic powder, and as compounds where Cu has different oxidation states: oxides, halides, salts, particularly sulfates, both anhydrous and hydrates; acetates, carbonates, etc. Zn may be present in metallic form, and as its oxide and salts, particularly, acetate, chloride, silicate, tungstate, etc. Mo may be present in metallic form, and as its compounds, e.g. in oxides, as carbides, nitrate, phosphides, sulfide, and molybdates of different monovalent cations, such as K, Na and $NH_4$. W may be used as, e.g., metallic W, tungsten oxide, sulfide, chlorides, tungstic acid, phosphotungstic acid, and tungstates of different monovalent cations, e.g. K, Na, and $NH_4$, but also as a tungstate of Zn. V may be as a metal, or its oxides, halides, and vanadates of K, Na and $NH_4$, etc. Sn may be present in its metallic form, or as oxides, sulfides, halides, etc. Ag may also be in its metallic form, or as an oxide, halide, nitrate, carbonate, etc. One, two, or more chemical forms of each component may be present in the composition.

In some embodiments, the composition according to this invention achieves its effect by being fixedly arranged at the point where fuel enters the engine of the vehicle, preferably, before the gasoline engine injector or the high-pressure pump of a diesel engine, and being allowed to come into contact with the fuel before combustion. To ensure this, the composition may be provided within (e.g., as part of, coated on, etc.) a three-dimensional product. The composition must be provided in a number of shapes within the product to enable contact of the composition with the fuel and flow-through of the fuel. Such shapes may constitute, as already mentioned earlier, various granules, rods, tubes, rings, cubes, pyramids, tablets, blocks, or bricks, etc.; and they may be obtained by, for instance, coating the composition of this invention on substrate, such as ceramics, plastics, metals, etc.

The coating of substrates may be accomplished, for instance, by pressing, or gluing the composition onto the substrate. In the case of gluing, the glue may be soluble in fuel, to allow gradual loosening of the particles of the composition. Alternatively, the shapes may be produced by forming the composition, for example, pressing it together, or incorporating the composition in a fuel-soluble matrix, to allow gradual loosening of the composition's nanoparticles and their suspension in the fuel.

Before coating on a substrate, shaping, or incorporating in a matrix, the composition according to embodiments of the present invention must be ground to a fine powder, all the components together, or separately, and thoroughly mixed afterward.

To enable contact with the fuel, the shapes may be enclosed in a volume, such as a container, cassette, or compartment having at least one inlet and at least one outlet for the fuel, and allowing flow-through of the fuel, effecting slow, gradual loosening of the composition's particles, which results in the presence of the composition in the fuel, entering the combustion engine, and thus the catalytic effect of the composition, e.g. fuel combustion rate increase, is enabled. In some embodiments, the composition may be used as coating for a tubing, or a conduit, which provides passage of fuel to the combustion engine.

The solid composition of the present invention, may, as appropriate, further contain additional components, including but not limited to excipients, fillers, bulking agents, binders, or solid diluents, such as, for example, polymeric particles, chalk, limestone, sand, sandy gravel, silica, borosilicate, ceramic, fly ash, clay; resins; acrylic, styrene, or vinyl polymer latex; alkyd, polyurethane, polyester, phenol formaldehyde or epoxy resin, and combinations thereof.

One, several, or all of the additional components may be soluble in fuel, for instance, such as gasoline, diesel fuel, etc. Fuel-soluble polymeric components may act in the role of glue, for coating the composition, or as a matrix, for shaping the composition in different forms.

The invention will be now further described by several examples which are intended to be descriptive, and not limiting the invention.

EXAMPLES

Example 1

This example presents average data (see Table 1 below) on the fuel savings and emission reduction for the period of efficiency of an effective amount of an exemplary embodiment of the composition according to the present invention, for various types of vehicles.

This exemplary embodiment of the composition included 50 wt. % Cu (copper), 28 wt. % Zn (zinc), 6 wt. % Mo (molybdenum), 4 wt. % W (tungsten), 6 wt. % V (vanadium), 3 wt. % Sn (tin), and 2 wt. % Ag (silver).

The effective amount of the composition provided for different types of vehicles depended on the size and power of the vehicle.

The effective amount of the composition for each type of vehicle was connected to a fuel line before the gasoline engine injector or the high-pressure pump of a diesel engine, in a compartment, having one inlet and one outlet, and allowed to come into contact with the fuel before its combustion.

The results of measurements showed a substantial elimination of soot emission, a significant decrease of nitrogen oxide and carbon monoxide, and a significant decrease in the emission of carbon dioxide and a decrease in fuel consumption.

TABLE 1

Fuel saving and emission reduction for the period of composition's efficiency:

| Indicators | Effect (%) |
|---|---|
| Fuel saving | 8-20% |
| $CO_2$ | 5-25% |
| CO | 30-60% |
| $NO_x$ | 25-55% |
| PM 2.5 & PM 10 | 70-90% |

The list of the vehicles that were used to obtain the Table 1 data is presented in Table 2 (see Table 2 below). The vehicles are of different make, usage, mileage, etc., but all of them demonstrated fuel savings and a decrease in the amount of emissions. The exemplary embodiment of the composition according to the present invention (i.e., an embodiment that included 50 wt. % copper, 28 wt. % zinc, 6 wt. % molybdenum, 4 wt. % tungsten, 6 wt. % vanadium, 3 wt. % tin, and 2 wt. % silver) was tested on passenger cars, trucks, various agricultural machinery (tractors, etc.), a locomotive, a cargo vessel, a small civil plane, and a civil helicopter.

TABLE 2

The list of vehicles and means of transportation on which the composition of the present invention was tested:

| Fuel type | Productivity 1/100 km & 1/hour | Type and make of vehicle, means of transport |
|---|---|---|
| Gasoline | 20 | Ford Focus (1.9 L), Volkswagen Golf VI (1.8 L), Chevrolet Lacetti (1.8 L), Ford Transit minivan (2.4 L), Hyundai Elantra 2010 (1.6 L) unmanned civil aerial vehicle M-22 Virage, Aeroprakt A-22LS two-seat aircraft |
| Diesel | 20 | Volkswagen T5 minivan (2.0 L), ISUZU NQR 71P van (4.5 L), JCB 3CX backhoe (4.4 L), Volkswagen Touareg (x2: 2.5 L, 3.0 L), MAZDA CX-5 (2.0 L), Peugeot 308 (1.6 L), Ford Transit Connect van (2.0 L) |
| Diesel | 40 | John Deere 9560 RT tractor (8.1 L), John Deere 8400 tractor (8.1 L), MAN TGA 18.430 truck (10.5 L), MAN TGA 5551A2 truck (11.1 L), RENAULT MAGNUM 500 truck (12.7 L), RENAULT T-430 (10.8 L), SCANIA G410 PDE truck (12.7 L), Scania G410 truck; x3 (12.74 L), DAF XF truck (9.5 L), DAF XF 95 truck (12.5 L), DAF XF 105.410 truck (12.8 L), VAN HOOL T917 Astron bus (9.1 L), MERCEDES ACTROS 1844LS (11.9 L) |

TABLE 2-continued

| The list of vehicles and means of transportation on which the composition of the present invention was tested: | | |
|---|---|---|
| Fuel type | Productivity 1/100 km & 1/hour | Type and make of vehicle, means of transport |
| Diesel | 60 | MAN LE 8.180 18 wheeler truck (4.6 L), KAMAZ 45143-62 dump truck (11.7 L), VOLVO FH500 truck (12.7 L) |
| Diesel | 80 | Helicopter MI-8 |
| Diesel | 250 | John Deere 9560 RT heavy tractor (28.7 L), Locomotive ChME3, Barge vessel (772 KW) |

Example 2

This example presents measurements of fuel consumption of a Volkswagen T5 van, with a 2 L diesel engine, with and without the use of the exemplary embodiment of the composition that included 50 wt. % copper, 28 wt. % zinc, 6 wt. % molybdenum, 4 wt. % tungsten, 6 wt. % vanadium, 3 wt. % tin, and 2 wt. % silver. The measurements were taken in two runs, first—without the above-described composition according to this exemplary embodiment, and second—with the above-described composition according to this exemplary embodiment.

The effective amount of the inventive composition added for this type of vehicle was fixedly arranged at the point where fuel entered the engine of the vehicle, and allowed to come into contact with the fuel before it entered the engine.

Consumption of fuel without the composition was measured for a road stretch of 100 km. Consumption of fuel per 100 km with use of the composition was measured for 200 km, all other conditions being equal. Both runs were started with a full tank of fuel.

Without the above-described inventive composition, the vehicle consumed 7.9 liters of fuel for 100 kilometers, and 7.0 liters with the above-described inventive composition, which constitutes a 11.3% fuel consumption decrease.

Example 3

Fuel consumption of a JOHN DEERE 8400 tractor with an 8.1 L diesel engine was measured, with and without the exemplary embodiment of the inventive composition that included 50 wt. % copper, 28 wt. % zinc, 6 wt. % molybdenum, 4 wt. % tungsten, 6 wt. % vanadium, 3 wt. % tin, and 2 wt. % silver. The tractor was parked, the engine worked at 1820 rev/min for the duration of this experiment. The measurements were taken for 1 hour, first without the inventive composition, and then with it, on a hot engine; consumption of fuel was measured gravimetrically. Volume values were obtained with the help of specific density 0.830 kg/l. One hour consumption of fuel by the tractor without the inventive composition amounted to 6.782 kg (8.171 l), and 5.477 kg (6.598 l) with the composition, i.e. demonstrating 18.9% decrease of fuel consumption.

Example 4

Two vehicles were selected for the pilot project, used by a company in operational activities to deliver water in the usual way without changing operational factors. The cars performed delivery on their usual routes, which determined the frequency of the same trips and had the same routes both before and after the installation of additional equipment.

The load of a car also has the same average value for these routes; the volume of goods before and after the installation of additional equipment were not kept.

The efficiency of the composition was determined by comparing the fuel consumption of refueling to refueling with the determination of the average fuel consumption per and after the installation of additional equipment. The inventive composition tested in this example was the same composition as in Examples 1-3, namely, a composition that included 50 wt. % copper, 28 wt. % zinc, 6 wt. % molybdenum, 4 wt. % tungsten, 6 wt. % vanadium, 3 wt. % tin, and 2 wt. % silver. The results are presented in Table 3 below.

TABLE 3

| Road fuel consumption tests of Ford Transit and MAN LE 8.180: | | | | |
|---|---|---|---|---|
| Vehicle | Inventive Composition | Distance, km | Consumption, 1 per 100 km | Fuel consumption reduction effect |
| Ford Transit van, 2.4 L diesel | Not Present | 4199 | 12.78 | 12.86% |
| | Present | 3880 | 12.2 | |
| MAN LE 8.180, 4.6 L diesel | Not Present | 2250 | 18.91 | 8.7% |
| | Present | 3690 | 17.34 | |

Example 5

Here demonstrated are the results of measurements taken on a passenger car, Peugeot 308, having a 1.6 L diesel engine (see Table 4, below).

Fuel consumption and levels of emission were measured while driving under various driving cycles according to Liu et al., 2017 (Emission Characterization of In-Use Diesel and Gasoline Euro 4 to Euro 6 Passenger Cars Tested on Chassis Dynamometer Bench and Emission Model Assessment, Liu, Yao, Martinet, Simon, Louis, Cedric, Pasquier, Anaïs, Tassel, P., Perret, Pascal, September 2017, Aerosol and Air Quality Research 17 (9), DOI: 10.4209/aaqr.2017.02.0080), with and without the inventive composition according to an embodiment of the present invention.

Except for the Road cycle, all other driving conditions demonstrate improvement in fuel consumption and lowering of emissions when the solid composition is used.

TABLE 4

Road fuel consumption and emission tests of Peugeot 308, 1.6 L

| Cycle | | Inventive Composition | $CO_2$ (g/km) | CO (mg/km) | $NO_x$ (mg/km) | PM (mg/km) | FC (1/100 km) |
|---|---|---|---|---|---|---|---|
| Artemis | Urban | without | 167.4 | 147 | 170.9 | 30.64 | 6.36 |
| | | with | 154.1 | 97.8 | 91.6 | 1.21 | 5.86 |
| | Road | without | 105.2 | 11.5 | 11.9 | 0.03 | 4.0 |
| | | with | 105.4 | 3.5 | 32.3 | 1.42 | 4.0 |
| | Motorway | without | 164.6 | 18.9 | 505.3 | 12.9 | 6.25 |
| | | with | 153.6 | 5.6 | 117.3 | 2.13 | 5.83 |
| WLTC | | without | 118.1 | 121.8 | 84.4 | 4.22 | 4.49 |
| | | with | 114.2 | 76.3 | 70.3 | 0.0 | 4.34 |

Example 6

This example presents data relating to fuel savings and emission reduction for several vehicles using another exemplary embodiment of the composition according to the present invention. This exemplary embodiment of the composition included 37 wt. % Cu (copper), 21 wt. % Zn (zinc), 10 wt. % Mo (molybdenum), 8 wt. % W (tungsten), 9 wt. % V (vanadium), 9 wt. % Sn (tin), and 5 wt. % Ag (silver).

The results of measurements showed a decrease of soot, nitrogen oxide and carbon monoxide emission, and a decrease in fuel consumption, but the decreases were less significant in comparison to the decreases achieved by the more preferable composition used in Examples 1-5.

TABLE 5

List of vehicles and means of transportation on which the embodiment of the composition including 37 wt. % copper, 21 wt. % zinc, 10 wt. % molybdenum, 8 wt. % tungsten, 9 wt. % vanadium, 9 wt. % tin, and 5 wt. % silver was tested.

| Fuel type | Productivity 1/100 km & 1/hour | Type and make of vehicle, means of transport |
|---|---|---|
| Gasoline | 20 | Chevrolet Lacetti (1.8 L) |
| Diesel | 20 | Ford Transit Connect van (2.0 L) |
| Diesel | 40 | Scania G410 truck (12.74 L) |

Example 7

This example presents data relating to fuel savings and emission reduction for several vehicles using another exemplary embodiment of the composition according to the present invention.

This exemplary embodiment of the composition included 60 wt. % Cu (copper), 33 wt. % Zn (zinc), 2 wt. % Mo (molybdenum), 1 wt. % W (tungsten), 1 wt. % V (vanadium), 1 wt. % Sn (tin), and 1 wt. % Ag (silver).

The results of measurements showed a decrease of soot, nitrogen oxide and carbon monoxide emission, and a decrease in fuel consumption, but the decreases were less significant in comparison to the decreases achieved by the more preferable composition used in Examples 1-5.

Notably, the decrease of soot, nitrogen oxide and carbon monoxide emission, and the decrease in fuel consumption, but the decreases were somewhat more significant in comparison to the decreases in emissions and fuel consumption achieved by the composition used in Example 6.

TABLE 6

List of vehicles and means of transportation on which the embodiment of the composition including 60 wt. % copper, 3 3 wt. % zinc, 2 wt. % molybdenum, 1 wt. % tungsten, 1 wt. % vanadium, 1 wt. % tin, and 1 wt. % silver was tested.

| Fuel type | Productivity 1/100 km & 1/hour | Type and make of vehicle, means of transport |
|---|---|---|
| Gasoline | 20 | Ford Transit minivan (2.4 L) |
| Diesel | 20 | Volkswagen Touareg (2.5 L) |
| Diesel | 40 | RENAULT MAGNUM 500 truck (12.7 L) |

While this invention has been described above by means of specific embodiments and applications thereof, numerous modifications and variations could be made thereto by those skilled in the art without departing from the scope of the invention set forth in the claims.

What is claimed is:

1. A solid composition comprising Cu (copper), Zn (zinc), Mo (molybdenum), W (tungsten), V (vanadium), Sn (tin), and Ag (silver), and at least one additional component selected from a group consisting of excipients, fillers, bulking agents, binders, and solid diluents.

2. The solid composition according to claim 1, further comprising at least one of oxides, hydroxides, and salts of at least one of the Cu, Zn, Mo, W, V, Sn, and Ag.

3. A solid composition comprising Cu (copper), Zn (zinc), Mo (molybdenum), W (tungsten), V (vanadium), Sn (tin), and Ag (silver), wherein:

the Cu is in the form of copper sulfate, the Zn is in the form of zinc acetate, the Mo, W and V are in the form of molybdates, wolframates and vanadates of monovalent cations, respectively, the Sn is in the form of salt, oxide, or hydroxide, and the Ag is in metallic form.

4. The solid composition according to claim 3, wherein:

the Cu is in the form of $CuSO_4$*5H2O and $CuSO_4$, or combinations thereof, the Zn is in the form of $Zn(CH_3COO)_2$*$2H_2O$, the Mo is in the form of $Na_2MoO_4$, $Na_2MoO_4$*$2H_2O$, and/or $(NH_4)_6Mo_7O_{24}$*$4H_2O$, or combinations thereof, the W is in the form of $Na_2WO_4$, $Na_2WO_4$ $2H_2O$, $3Na_2WO_4$*$9WO_3$*$xH_2O$, or combinations thereof, the V is in the form of $KVO_3$, $NaVO_3$, and/or $NH_4VO_3$, or combinations thereof, and the Sn is in the form of SnO.

5. A solid composition comprising:

between about 35 and about 70 wt. % Cu (copper), between about 20 and about 40 wt. % Zn (zinc), between about 1 and about 10 wt. % Mo (molybdenum, between about 1 and about 10 wt. % W (tungsten), between about 1 and about 10 wt. % V (vanadium), between about 1 and about 10 wt. % Sn (tin), and between about 1 and about 5 wt. % Ag (silver).

6. The solid composition according to claim 1, wherein the at least one additional component includes: polymeric particles, chalk, limestone, sand, sandy gravel, silica, borosilicate, ceramic, fly ash, clay, resin, acrylic, styrene, vinyl polymer latex, alkyd, polyurethane, polyester, phenol formaldehyde, epoxy resin, and combinations thereof.

7. The solid composition according to claim 6, wherein the at least one of the additional component is soluble in fuel.

8. A three-dimensional product comprising the solid composition according to claim 1.

9. A method of obtaining the three-dimensional product according to claim 7, wherein the solid composition is formed, coated on the surface of inert substrate, or, enclosed in a fuel-soluble matrix.

10. A method for increasing efficiency of a combustion engine, wherein, prior to ignition of the combustion engine, fuel is brought into contact with the solid composition of claim 1.

11. The method according to claim 10, wherein the increasing of the efficiency further comprises decreasing fuel consumption and emission levels of the combustion engine, wherein emission of the combustion engine comprises soot, carbon monoxide (CO), carbon dioxide ($CO_2$) and nitrogen oxides (NOx).

12. A method of increasing efficiency of a combustion engine, wherein, prior to ignition of the combustion engine, fuel is brought into contact with the three-dimensional product according to claim 8.

13. The method according to claim 12, wherein the increasing of the efficiency further comprises decreasing fuel consumption and emission levels of the combustion engine, wherein emission of the combustion engine comprises soot, carbon monoxide (CO), carbon dioxide ($CO_2$) and nitrogen oxides (NOx).

* * * * *